United States Patent [19]

Claussen

[11] Patent Number: 4,962,707

[45] Date of Patent: Oct. 16, 1990

[54] APPARATUS FOR PRINTING UNIFORMLY, WITH TOTAL DIE CONTACT UTILIZING A PIVOTING DRUM AND TWO AIR CYLINDERS

[76] Inventor: Gary J. Claussen, 31 King Ave. #4, Billings, Mont. 59102

[21] Appl. No.: 938,502

[22] Filed: Dec. 5, 1986

[51] Int. Cl.[5] ..... B41F 17/00

[52] U.S. Cl. ..... 101/212; 101/35

[58] Field of Search ..... 101/212, 35

[56] References Cited

U.S. PATENT DOCUMENTS

| | | | |
|---|---|---|---|
| 316,836 | 4/1885 | Berge | 101/36 |
| 890,637 | 6/1908 | Gallozzi | 101/213 |
| 1,436,257 | 11/1922 | Hogan | 101/213 |
| 1,840,466 | 1/1932 | Quigley | 101/36 |
| 2,344,610 | 3/1944 | Hargraves | 101/36 |
| 2,778,296 | 1/1957 | DeKoning | 101/37 |
| 3,086,461 | 4/1963 | Gill | 101/213 |
| 4,077,318 | 3/1978 | Tamai | 101/37 |

FOREIGN PATENT DOCUMENTS

| | | | |
|---|---|---|---|
| 1169614 | 9/1958 | France | 101/213 |

*Primary Examiner*—Clifford D. Crowder

*Attorney, Agent, or Firm*—Robert S. Smith

[57] ABSTRACT

Printing apparatus includes a print drum having a raised image for printing disposed on the circumference thereof and having a central bore, a shaft dimensioned for engagement with the central bore in the print drum and a scissor linkage supporting each end of the shaft. Each scissor arrangement comprises first and second pivotably connected arms, the opposite ends of the first and second pivotably connected arms are respectively connected to the shaft and the mounting plate and first and second pneumatic cylinders pivotably connected to the mounting plate and the respective ends of the shaft.

6 Claims, 3 Drawing Sheets

APPARATUS FOR PRINTING UNIFORMLY, WITH TOTAL DIE CONTACT UTILIZING A PIVOTING DRUM AND TWO AIR CYLINDERS

BACKGROUND OF THE INVENTION

The invention relates to printing apparatus and particularly to the aspect of such apparatus for applying ink to a surface on which an image is disposed which is to be applied to another surface. While the invention has particular application to flexotype apparatus and particularly to such apparatus utilized for marking wood based panel sheets which typically may be 4'×8' and ¼" to ¾" thick. Examples include plywood, particle board, wafer board and oriented strand board. It will be understood the invention also has application to other printing apparatus. In flexotype printing apparatus, ink disposed on a first roller is applied to a second roller on which an image is disposed. The image on the second roller is then passed over the panel or other surface on which the image is to be printed. This is in contrast to offset printing in which print ink on a first roller is applied to a second roller which is then applied to a roller on which the image to be printed is disposed.

In the lumber and panel industry there is a requirement to identify individual pieces of lumber and panels with grade and identification markings. Some prior art apparatus does use a roll which has a substantially solid circumferential face in which the ink is disposed. This arrangement is in contrast to liquid ink feeding apparatus. The ease with which the ink is transferred to the printing element or image before it is transferred from the image to a piece of lumber is of great importance. If proper inking occurs, the ink is transferred and a complete image will be produced on the lumber. If too much or too little ink is transferred, the printing will be illegible on the wood product.

A difficulty which is particularly acute in the marking of warped plywood panels that in such printing is the cylindrical printing drum is customarily mounted on an axis of rotation which is fixed and the printing drum is pulled into contact by a single, centrally located air cylinder connected by a yoke to the drum shaft at both ends. The ink drum passes over the warped plywood panel or other irregular surface on which a printed image is to be placed is incomplete, non-uniform, smudged, or otherwise illegible. Illegible markings are unacceptable in the wood products industry as well as in many other applications where marking is to be placed on an irregular surface.

It is an object of the present invention to provide printing apparatus which will consistently produce sharp, clear, uniform, and complete printed images on irregular surfaces, and improves the printed images on regular surfaces.

It is still another object of the invention to provide apparatus which is particularly adapted for use in printing images on warped lumber and particularly warped wood based panels.

It is another object of the invention to provide apparatus which will have reliability and image definition which is for greater than existing apparatus.

It is still another object of the invention to provide apparatus which will react quickly to produce a clear and complete image even if the relative speed between the printing drum and the irregular material upon which the printing is occurring it is quite high.

SUMMARY OF THE INVENTION

It has now been found that these and other objects of the invention may be attained in an apparatus for printing which comprises a print drum having a raised image for printing disposed on the circumference thereof and having a central bore, a shaft dimensioned for engagement with the central bore in the print drum, a rotatably mounted pivot plate, and a scissor linkage supporting each end of the print drum shaft. Each scissor arrangement comprises pairs of spaced first and second pivotably connected arms, the opposite ends of the first and second pivotably connected arms are respectively connected to the shaft and the mounting plate. The apparatus also includes first and second means for biasing the position of the first and second arms to vary the position of the print drum.

This embodiment of the apparatus in accordance with the invention may further include a first and second means for biasing which includes pneumatic cylinders pivotably connected to the mounting plate and the respective ends of the shaft. The apparatus may further include means for mounting the mounting plate to permit drum pivot rotation about an axis and to permit rotation about an axis which lies at the intersection of a plane which is parallel to the axis of rotation of the print drum and another plane which is perpendicular to the axis of the print drum. The first and second pneumatic cylinder may bias the pairs of first and second arms during normal operation in a manner that causes the first and second arms to decrease the included angle therebetween.

BRIEF DESCRIPTION OF THE DRAWING

The invention will be better understood by reference to the accompanying drawing in which.

DESCRIPTION OF THE PREFERRED EMBODIMENT

Referring now to FIGS. 1–6 there is shown the printing apparatus 10 in accordance with one form of the invention. The apparatus 10 is particularly adapted for use in printing wood based panels with identification markings in a panel mill although other applications will be apparent to those skilled in the art. The apparatus 10 includes a printing drum 12. The printing drum 12 will ordinarily cooperate with an ink drum (not shown) which rotates in circumferentially abutting relationship with an ink drum (not shown) which causes ink to be applied to an image (not shown) on the circumference of the printing drum 12 so that upon subsequent rotation of the printing drum 12 against a plywood panel 14 the image is clearly printed on the plywood panel 14. The construction of a particularly suitable ink drum is shown in greater detail in U.S. Pat. No. 4,627,349 issued to the applicant herein.

Figure 2:
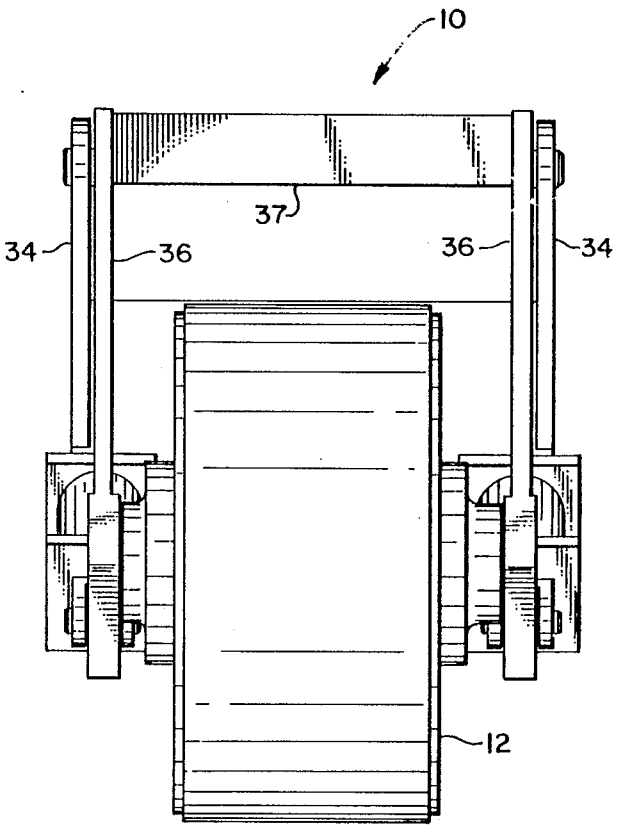
FIG. 2 is a front elevational view of the apparatus shown in FIG. 1.
Figure 1:
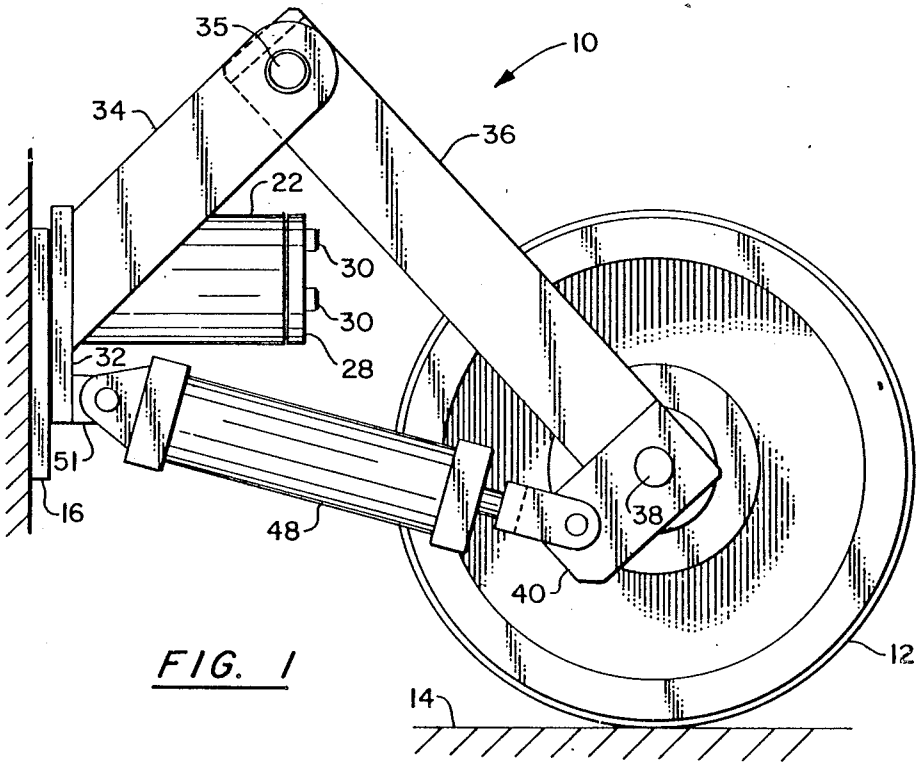
FIG. 1 is a partially schematic side elevational view of one form of the apparatus in accordance with the invention.
Figure 4:
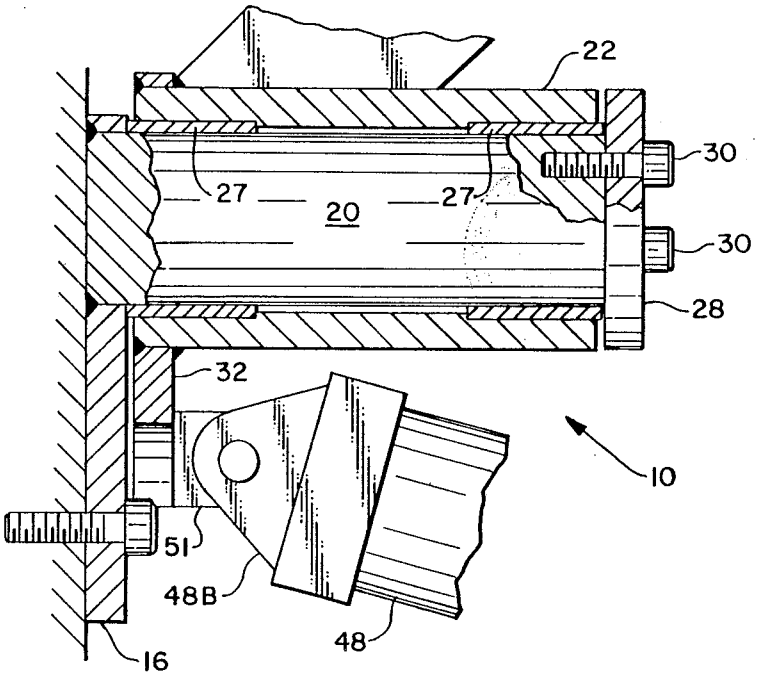
FIG. 4 is a partially broken away sectional view taken along the center line of the cantilevered cylindrical beam shown in FIG. 3.
Figure 3:
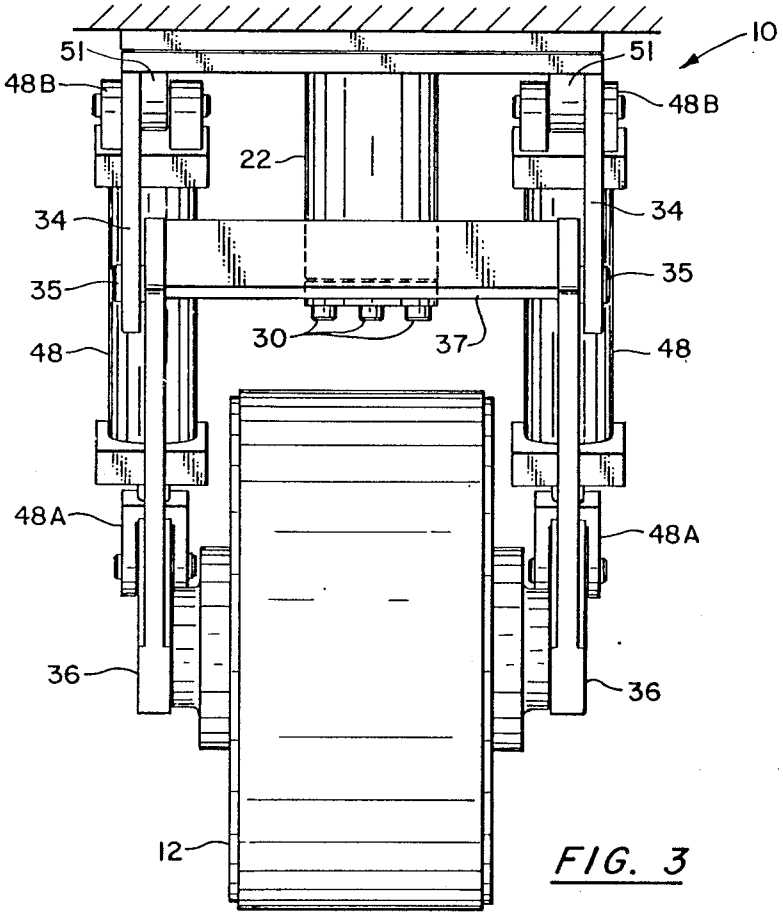
FIG. 3 is a plan view of the apparatus shown in FIG. 1.

The apparatus 10 includes a stationary mounting plate 16 as best seen in FIGS. 1 and 4. Cantilevered circular beam or elongated boss 20 is welded to the stationary mounting plate 16 to provide a stationary mounting surface for a sleeve 22 which is retained in place on the beam 20 by a cap 28 which is in turn retained on the beam 20 by screws 30,30. Journal bearings 27,27 preferably of the Oilite type allow easy rotational movement of the sleeve 22 about the beam 20. The geometric axis of the sleeve and the cantilevered cylindrical beam are coextensive. In addition, the axis of each of these members lies in a plane which is perpendicular to the axis of rotation of the print drum. Fixed to the sleeve 22 is a movable (pivoting) plate 32 on which the structure supporting the printing drum 12 is mounted.

The structure includes a pair of spaced apart first arms 34,34 which are welded to the movable plate 32 on opposite sides of the sleeve 22. The first arms 34,34 extend in oblique relationship from the movable plate 32 at an angle of approximately 45 degrees upwardly from a horizontal plane. Coupled to the respective first arms 34,34 by means of respective pins 35,35 are respective second arms 36,36. The pins 35,35 allow relative pivotable motion between the respective second arms 36,36 and the respective first arms 34,34. The connection of the first arms 34,34 to the respective second arms 36,36 is at respectively the free ends of the first arms 34,34 and a first axial extremity of the respective second arms 36,36. The respective second arms 36,36 are joined by a cross member 37 to reinforce the structure. At the second axial extremity of each second arm 36 a shaft 38 is provided for the printing drum 12.

Connected to the second axial extremities of each of the second arms 36,36 are respective third arms 40,40 which are fixed respectively to the second extremities of the respective second arms 36,36. Coupled between the rotating plate 32 and the respective third arms 40,40 are respective pneumatic cylinders 48,48. The pneumatic cylinders 48,48 are pivoted respectively at their free axial extremities to the respective third arms 40,40 by means of respective pivotally connected yokes 48A,48A integral with the respective cylinders 48,48. At the opposite ends of the respective pneumatic cylinders 48,48 are respective yokes 48B,48B which are pivotally connected to respective mounting elements 51,51 welded to the movable plate 32.

Figure 5:
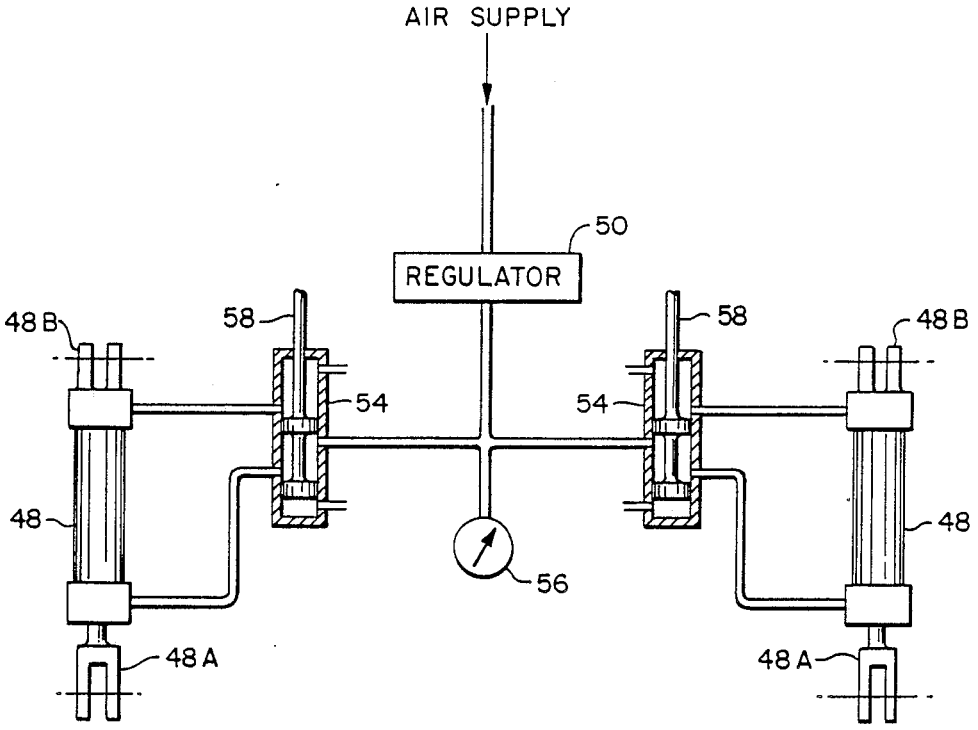
FIG. 5 is a schematic view illustrating the pneumatic control circuitry employed in one form of the apparatus in FIG. 1.

Referring specifically to FIG. 5 there is shown schematically one pneumatic arrangement of the invention. It will be understood that other forms of the invention may also be used. In the illustrated form, the apparatus includes a regulator 50 which feeds each of two pilot or spool valves 54,54. A gauge 56 indicates the pressure being supplied by the regulator 50. The regulator 50 is adjustable to provide an appropriate pressure to the pneumatic cylinders 48,48. The pilot or spool valves 54,54 in this form of the invention have respective spool shaped central members 58,58 which are free to move axially with the respective valves 54. The pilot spool shaped members 58,58 move axially within each of the pilot or spool valves 54,54. Each spool shaped member 58,58 directs the relatively high pressure air from the regulator 50 to either the upper or lower (as viewed) extremity of the respective pneumatic cylinders 48,48 and thus controls the movement of the respective pneumatic cylinders 48,48. It will be understood that a piston shaped member (not shown) is an inherent part of each pneumatic cylinder 48,48 and that this piston is urged either up and down (as viewed) by virtue of the air pressure passed from the regulator 50 through one of the pilot valves 54,54 to one or the other sides of the piston (not shown) of each pneumatic cylinder 48,48. The pilot valves 54,54 will ordinarily be actuated in a conventional manner by one or more springs and at least one cam (not shown). As shown, both spool shaped members 58,58 are positioned to direct high pressure air to the lower extremity of respective pneumatic cylinders 54,54. In addition, each spool shaped member is positioned as viewed to vent the upper axial extremity of each cylinder 54,54 to ambient. It will be understood that either spool shaped member 58,58 may be raised upwardly from the positions shown in FIG. 5 so that regulated air pressure from the regulator 50 will pass to the upper axial extremity of the respective pneumatic cylinders 48,48. It will be further understood that each pilot valve 54,54 is provided with vent ports for venting the opposite axial extremity of the pneumatic cylinders 48,48 when relatively high pressure regulated air is passed through a pilot valve 54,54 to one axial extremity of the corresponding pneumatic cylinder 48. The opposite axial extremity of each pneumatic cylinder 48,48 is automatically vented through a respective pilot valve 54 when positive pressure is applied to one axial extremity of the pneumatic cylinder 48.

In operation, the use of dual cylinders 48,48 has significant design functions. More specifically, the failure of any one pneumatic cylinder 48 will not cause the apparatus 10 to be inoperative. In addition, the use of dual cylinders 48,48, is the primary design consideration which places maximum force vectors (transferred to the drum 12 driving rims, against the warped panel surface) in an action—which immediately creates a moment arm that instantly pivots the drum 12 square with the warped surface. The dual air cylinder orientation and power constantly applied to the drum 12 driving rims keeps the drum flat against the panel, yielding complete, uniform and legible prints.

Figure 6:
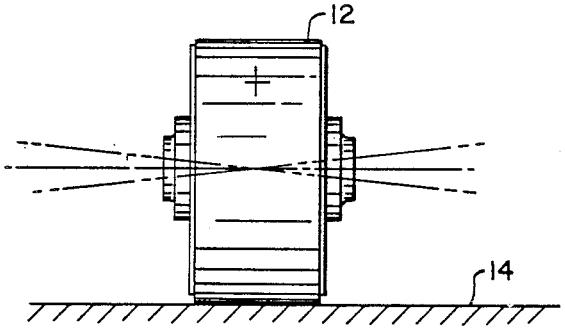
FIG. 6 is a partially schematic elevational view illustrating the pivoting action of the print drum to accommodate warped plywood panels.

In operation, as best seen in FIG. 6 a warped plywood panel would be passed under the print drum 12 for repetitively printing a grade or other mark on the plywood panel. In the case of a warped wood panel, including plywood panels, the conventional mechanism will not properly track the warped panel because the print drum will be mounted on a fixed axis that cannot pivot to conform to the warp. The present apparatus, unlike the known apparatus has the shaft of the print drum 12 mounted for movement about the geometric axis of the cantilevered beam or elongated boss 20. Thus, as is best shown in FIG. 6 the print drum 12 is free to rotate because the present apparatus 10 allows rotation of the rotating plate 32 and hence the shaft 38 which is the axis for the print drum 12 so that the geometric axis of the print drum 12 is at all time substantially parallel to the line of contact between the print drum 12 and the warped panel. This warped panel shape is illustrated by the phantom line of FIG. 6.

It will be understood, that the pneumatic cylinders 48,48 draw the print drum 12 against the plywood panel upon which printing is being accomplished. In other words, even if the panel is warped, the face of the print drum will move to firmly press against the panel even if the overall panel is not planar and the specific surface upon which printing is occurring is not precisely in a plane which is exactly parallel to the location of the axis of a more conventional mounting apparatus for the print drum.

It will thus be seen that apparatus in accordance with the invention provides very fast response to irregularities in the surface as well as providing very high quality imprints which are not smudged and which will function despite surface irregularities such as warped plywood panels.

It will be understood that various modifications will be apparent to those skilled in the art and that such modifications include the use of a hydraulic system and various other pilot valve arrangements which will accomplish the same means. For example, the pneumatic cylinders may have some bleed holes in them to relieve air pressure. In other embodiments, a hydraulic fluid may be used instead of air to operate the cylinders. Those skilled in the art will readily understand other changes which will be necessary to accommodate such hydraulic fluid.

It will also be understood that it is conceptually possible to use tension springs instead of the pneumatic cylinders for some applications of the invention.

The invention has been described with reference to its illustrated preferred embodiment. Persons skilled in the art of printing apparatus may upon exposure to the teachings herein, conceive other variations. Such variations are deemed to be encompassed by the disclosure, the invention being delimited only by the appended claims.

Having thus described my invention I claim:

1. Apparatus for printing which comprises:

a print drum having a raised image for printing disposed on the circumference thereof and having a central bore;

a shaft dimensioned for engagement with said central bore in said print drum; and means for swiveling to ensure said print drum maintains contact along substantially the entire axial extent thereof with even warped surfaces upon which printing is to occur which comprises a rotatably mounted plate; a scissor linkage supporting each end of said shaft, each scissor arrangement comprising pairs of spaced first and second pivotably connected arms, the opposite ends of said first and second pivotably connected arms being respectively connected to said shaft and said rotatably mounted plate; and first and second means for biasing the position of said first and second arms to vary the position of said print drum.

2. Apparatus for printing which comprises:

a print drum having a raised image for printing disposed on the circumference thereof and having a central bore;

a shaft dimensioned for engagement with said central bore in said print drum; and means for swiveling to ensure said print drum maintains contact along substantially the entire axial extent thereof with even warped surfaces upon which printing is to occur which comprises a rotatably mounted plate; a scissor linkage supporting each end of said shaft, each scissor linkage comprising pairs of spaced first and second pivotably connected arms, the opposite ends of said first and second pivotably connected arms being respectively connected to said shaft and said rotatably mounted plate; and first and second pneumatic cylinders pivotably connected to said mounting plate and said respective ends of said shaft.

3. The apparatus as described in claim 2 further including:

means for mounting said rotatably mounted plate to permit rotation about an axis.

4. The apparatus as described in claim 3 further including:

means for mounting said rotatably mounted plate to permit rotation about an axis which lies at the intersection of a plane which is parallel to the axis of rotation of said print drum and another plane which is perpendicular to the axis of said print drum.

5. The apparatus as described in claim 4 wherein:

said first and second pneumatic cylinder bias said pairs of first and second arms during normal operation in a manner that causes said first and second arms to decrease the included angle therebetween.

6. Apparatus for printing which comprises:

a print drum having a raised image for printing disposed on the circumference thereof and having a central bore;

a shaft dimensioned for engagement with said central bore in said print drum; and means for swiveling to ensure said print drum maintains contact along substantially the entire axial extent thereof with even warped surfaces upon which printing is to occur which comprises a rotatably mounted plate; a linkage supporting each end of said shaft, each linkage comprising pairs of spaced first and second pivotably connected arms, the opposite ends of said first and second pivotably connected arms being respectively connected to said shaft and said rotatably mounted plate; and first and second means for biasing the position of said first and second arms to vary the position of said print drum.

* * * * *